US005213542A

United States Patent [19]

Kelly

[11] Patent Number: 5,213,542

[45] Date of Patent: May 25, 1993

[54] INSULATED HEAT ACTIVATED VENTILATOR

[76] Inventor: Thomas L. Kelly, Kelly Energy Systems, Inc., P.O. Box 2583, Waterbury, Conn. 06723

[21] Appl. No.: 889,990

[22] Filed: May 29, 1992

[51] Int. Cl.[5] ..... F24F 11/02

[52] U.S. Cl. ..... 454/357; 49/7; 454/368

[58] Field of Search ..... 49/7; 137/72, 74; 454/257, 342, 343, 357, 366, 368, 369

[56] References Cited

U.S. PATENT DOCUMENTS

| | | | |
|---|---|---|---|
| 396,858 | 7/1976 | Naidus | 52/232 |
| 609,278 | 8/1898 | Kane | 454/357 |
| 821,416 | 5/1906 | Hummel | 454/342 |
| 863,059 | 8/1907 | Elmer | 454/357 |
| 2,416,284 | 2/1947 | Brown | 454/357 X |
| 2,803,318 | 8/1957 | Nickerson | 49/7 |
| 3,251,158 | 5/1966 | Shapiro | 52/1 |
| 3,685,426 | 8/1972 | Rosa . | |
| 3,731,442 | 5/1973 | Kiyoshi | 49/7 X |
| 3,818,816 | 6/1974 | Petit | 454/342 |
| 3,918,226 | 11/1975 | Naidus | 52/232 |
| 3,924,372 | 12/1975 | Anghinetti et al. | 52/232 |
| 4,190,987 | 3/1980 | Naidus | 49/1 X |

OTHER PUBLICATIONS

Milcor Pamphlet—Heat and Smoke Vents, Roof Hatches, Sidewalk and Floor Doors, Milcor Limited Partnership, Lima, Ohio, 07720/mil. Sep. 1991.

APC Fire Vents, Explosion Vents and Skylights, APC Corporation, Hawthorne, N.J., 886APC. May, 1992.

*Primary Examiner*—Harold Joyce

*Attorney, Agent, or Firm*—Hayes & Reinsmith

[57] ABSTRACT

A building construction includes a building structure and a ventilator, the ventilator having a stack defining a vent passage, a closure being provided for normally sealing off the vent passage, insulating material supported by the closure and providing an air seal within the vent passage under normal conditions, and vent actuating means operative in response to the presence of combustion products to disable the closure, automatically release the insulating material and exhaust combustion products through the vent passage.

11 Claims, 2 Drawing Sheets

INSULATED HEAT ACTIVATED VENTILATOR

FIELD OF THE INVENTION

This invention relates to a building venting mechanism, and more specifically to an insulated ventilator installed within a building structure for automatically ventilating smoke, heat and hot gases from underneath a roof.

BACKGROUND OF THE INVENTION

Conventional building construction has contemplated the sealing and containing of a fire source within a building. Fire doors of one to three hour ratings have been installed, walls were built to "compartmentalize" building sections with one to three hour ratings, to contain a fire in specific building components for predetermined periods of time. Roof and ceiling constructions were fire tested and evaluated in half hour to three hour containment criteria. The aim of such fire confinement is that the total consumption of the oxygen in the contained area will snuff out the fire.

With conventional fire containment philosophy, smoke and gases from partially burnt products and heat will reach a flash point. A spontaneous combustion explosion will occur when oxygen is introduced into a fire containment area, exposing smoke, gases, and entrapped heat thus spreading the fire rapidly throughout the total building from the fire entrapped area.

This invention is directed to precisely an opposite concept. This invention concerns the venting of heat, smoke and gases, hereafter collectively referred to as the combustion products of a fire, generated during fire within a building, directly out of the fire source. Such smoke, gases and heat build-up generated during a fire are the primary life threatening concerns, rather than the actual fire flames.

This invention accordingly seeks to ventilate fire as soon as detected, to vacate the heat, smoke and gases which are primarily responsible for loss of life. In addition, by venting a fire in a defined space, the consumable matter can be consumed by a fire in a building space and thus prevent build-up of smoke, gases and heat which will likely cause spontaneous spreading of fire throughout the building.

So-called smoke hatches are known to have been used in storage buildings with quantities of combustible or explosive materials, and in some instances, are required under uniform building code provisions. Most smoke hatches or vents are in the nature of a spring loaded door, hatch or skylight with a fusible link. Typically, heat or smoke vents are required in (a) single story buildings of non-hazardous use where the undivided floor area is over 50,000 square feet, (b) buildings as noted above with hazardous materials or uses when a single floor area exceeds 15,000 square feet, and (c) over stages larger than 500 square feet. While these are broad outlines of code requirements, such requirements vary from area to area.

Also, in recent years, automatic venting of building structures has been developed as an alternative and/or supplement to use of sprinkler systems to combat fires in commercial, industrial and residential buildings. In the event of fire, an automatic fire ventilator prevents buildup of gases which may create explosive conditions, as well as allowing heat and smoke to escape from a burning building Moreover, in buildings with extensive open or unpartitioned interiors, activated ventilators aid in locating the fire so it can be effectively fought from above while minimizing the need for cutting holes in the roof.

Several automatic fire venting devices have been developed and employed with success in conjunction with roofing structures. Examples of drop-out fire vents are shown in Nickerson U.S. Pat. No. 2,803,318 and Anghinetti et al U.S. Pat. No. 3,924,372. Additionally, Elmer U.S. Pat. No. 863,059 discloses a vent incorporating a fusible plug which, when heated, activates a sliding valve to release a closure and open the vent to atmosphere.

While fire vents, heat actuated skylights and trap doors have alleviated some of the above mentioned problems, they are capable of being inadvertently blown open by wind or other malfunctions due to mechanical specifications of the release mechanisms and usually do not provide a desired flexibility for different applications such as on roofing members or to effect desired venting of discrete levels of a multi-level building. Moreover, these conventional large metal vents, doors and acrylic skylights frequently introduce waterproofing and insulating problems in addition to normally requiring significant structural alterations to accommodate such units.

OBJECTS OF THE INVENTION

A principal object of this invention is to provide a new and improved ventilator for a building which will automatically open in response to smoke or to temperature reaching a predetermined level, thereby to reduce smoke, combustion gases and flame and to contain any undesired spread of fire within the building.

Another object of this invention to provide such an automatic ventilator which is simple in construction, durable, and provides reliable thermal insulation and weather protection of exceptionally high integrity to a roofing structure without adversely affecting the performance of the ventilator during a fire.

Other objects will be in part obvious and in part pointed out in more detail hereinafter.

BRIEF SUMMARY OF THE INVENTION

The ventilator of this invention features a stack provided with insulating material to effect an air seal of high integrity. The insulating material is normally held in place by a closure which seals a passage of the stack. Vent actuating means are associated with the closure. When subjected to combustion products, the vent actuating means disables the closure to effect exhaust of such combustion products.

A better understanding of the objects, advantages, features, properties and relations of the invention will be obtained from the following detailed description and accompanying drawings which set forth illustrative embodiments and are indicative of the various ways in which the principle of the invention is employed.

DETAILED DESCRIPTION OF A PREFERRED EMBODIMENT

Figure 1:
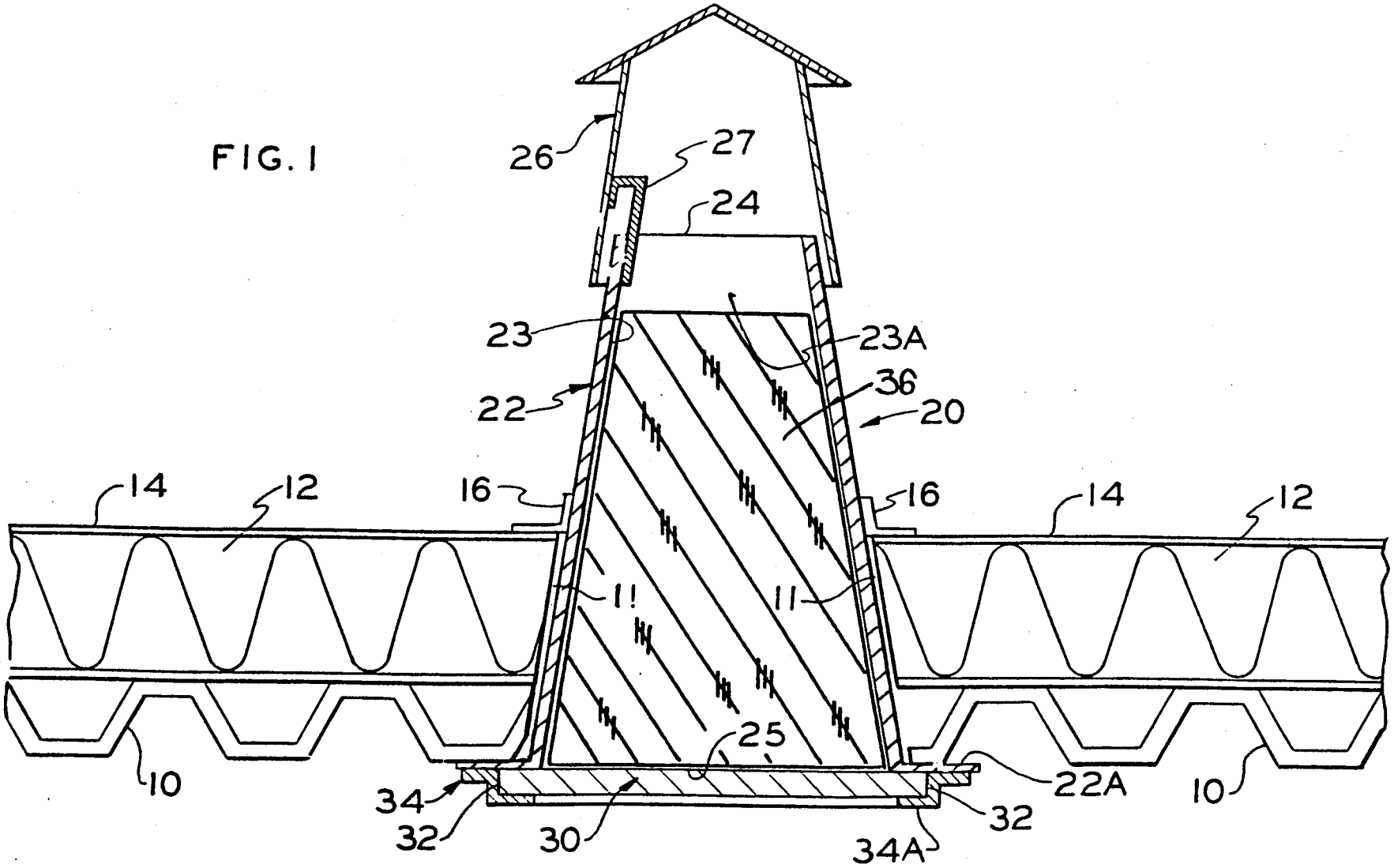
FIG. 1 is a view, partly in section and partly broken away, of a ventilator of this invention installed within a roof structure.

A conventional roof structure incorporating the automatic ventilator of the present invention is illustrated in FIG. 1, wherein a steel deck 10, insulation 12 and a weatherproof rubber sheet or membrane 14, preferably formed of conventional ethylene, polypropylene or expanded polydiene monomer (EPDM) rubber material, are shown. Deck 10 is mounted on a conventional support, not shown. Membrane 14 provides an exterior protective insulation cover resistant to ultraviolet or chemical discoloration, water absorption and extreme temperature changes.

To provide an inexpensive, insulated fireport requiring a simple and modest modification to an existing building for exhausting combustion products such as smoke, gases and/or heat from under a roof structure to atmosphere in the event of a fire, a ventilator 20 is installed within a small opening 11 cut within the roof structure. More specifically, ventilator 20 includes a stack 22 which, in the preferred embodiment, is shown as a hollow truncated cone having an inside wall surface 23 defining a passage 23A with an upper outlet 24 and a lower inlet 25. In the specifically illustrated embodiment, the base of the stack 22 is shown having a radial flange 22A which is secured to an underside of deck 10 by fasteners, now shown. Stack 22 extends upwardly from deck 10 and protrudes a predetermined distance above upper membrane 14. A vent cap 26 is shown supported upon stack 22 by any conventional means, for example, by a plurality of spaced straps such as the one shown at 27 which will be understood to be secured by suitable fasteners, not shown, to the wall surface 23 and to the cap 26. Cap 26 covers the stack 22 in overlying relation with a bottom skirt of cap 26 overhanging the upper portion of stack 22 in spaced relation thereto and providing an air flow space between members 22, 26. Accordingly, this construction prevents rain, snow, sleet, and the like from entering passage 23. For sealing roof opening 11, flashing 16 (of weather and fire resistant material) is shown overlying exposed adjacent portions of stack 22 and roofing membrane 14, it being understood that a fire flange or heat resistant insulation may be optionally used.

Ventilator 20 further includes a closure 30 which, in the preferred embodiment, seals inlet 25 of stack 22 below deck 10. Closure 30 may be formed of any suitable material such as insulation, metal, glass or other form-sustaining material. Closure 30 has an outer peripheral rim 32 which is located radially outwardly beyond stack 22 to completely close inlet 25. To fix closure 30 in position, it is shown secured to deck 10 by suitable means such as an annular retainer illustrated at 34 and secured by any known fastener means, not shown, to radial flange 22A of stack 22. It will be understood that closure 30 may be retained by other means such as by a plurality of releasable latches, clips or spring fingers.

In accordance with another feature of this invention, ventilator 20 provides vent actuating means for automatically venting combustion products of a fire from within a building. Retainer 34, which supports closure 30 in fixed relation to stack 22 and deck 10, may be formed of a suitable material which, when subjected to heat, releases closure 30 and thereby serves as an automatic vent actuator. The retainer 34 may be formed, or partially formed, e.g., of a suitable plastics material which is known to soften sufficiently in a predetermined time period at a given temperature level to provide closure dropout meeting certain standard test requirements, say, such as that of Factory Mutual Research Corporation. Alternatively, retainer base portion 34A, which is shown in the drawing as the lowermost offset portion of flange 34 extending radially inwardly in underlying relation to closure rim 32, also may be formed of fusible material. The response of fusible retainer portion 34A to heat of a fire results in that portion 34A being liquified by heat, usually at a temperature below 300° F., to automatically release closure 30 and vent the underlying space.

This invention further contemplates a meltable or fusible material being incorporated in closure 30 which enables it to drop free of retainer 34 and provide an exhaust opening for the escape of combustion gases, smoke and heat from below deck 10 upon closure 30 being exposed to the heat of combustion. In this respect, closure 30 may be formed in its entirety of such a meltable material (insulation, for example) or may be formed with only a rim or other zone of weakness made of the described meltable or fusible material which may be preselected to release at a desired temperature. As previously noted, these materials preferably melt or fuse below 300° F.

In the event of a fire within a building having a ventilator 20 with a closure 30 formed of such meltable insulation, the closure 30 is continuously exposed to increasingly higher temperatures as the heat rises which causes closure 30 to soften, sag and finally drop from its retainer 34. When closure 30 drops, ventilator 20 is activated, thereby permitting the escape of smoke and hot gases through inlet 25 from below deck 10.

In accordance with yet another feature of this invention, stack 22 provides effective resistance to undesired passage of air through stack 22 by the provision of insulation. Such insulation may be either a loose fill arrangement, not shown, or a closely fitted solid insulating core or plug illustrated at 36 within passage 23A. In the case of a solid insulating core 36, such a core may be formed to extend well above outlet 25, if desired, to further minimize the possibility of accumulation of snow or other undesired foreign matters. Such insulation is supported by closure 30 within the wall surface 23 and serves to promote the integrity of the sealed roof structure while being readily dropped out with closure 30 under the force of gravity upon automatic venting of stack 22.

Figure 2:
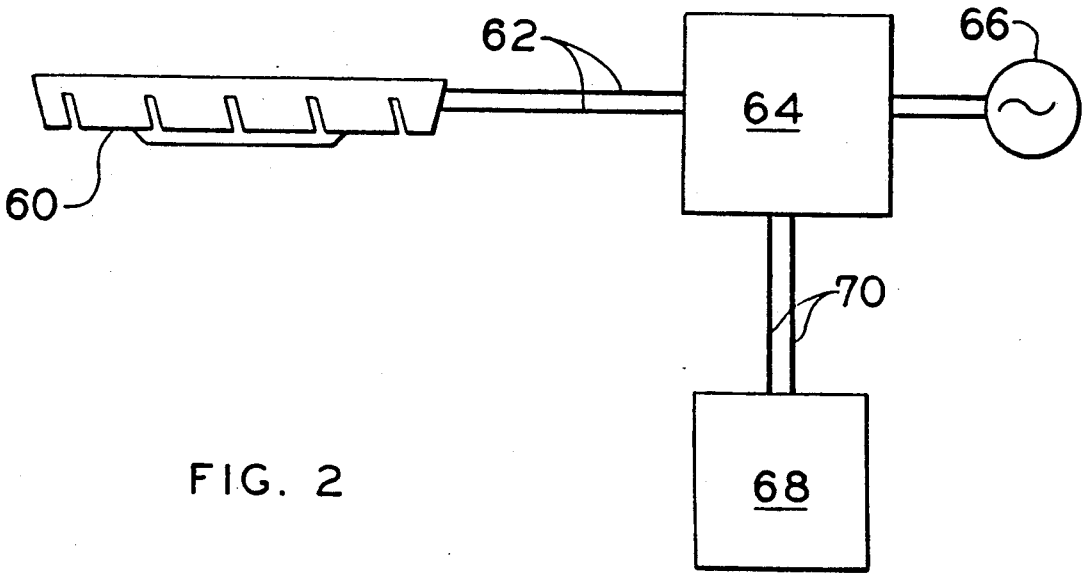
FIG. 2 is a schematic diagram of a smoke sensor which may be used with the ventilator of FIG. 1.

For early detection of fire within a building, a sensor 60 (FIG. 2) for indicating the presence of combustion products such as a smoke alarm, gas or heat sensor may be mounted on the bottom surface of closure 30 or at least in proximity to ventilator 20. Upon being activated, sensor 60 will be understood to provide a signal through lead wires 62 to modify a control element 64 energized by power source 66 to activate a releasable support 68 (such as a fusible link) for closure 30 via an output signal provided by lead wires 70. The output signal may effect disablement of the releasable support 68, by heating a fusible link or a plurality of heat releasable spring fingers to drop closure 30, or by energizing a relay, not shown, to release a mechanical closure latch, for example.

Ventilators of the type disclosed are preferably provided in a preselected pattern within inner peripheral confines of the roof structure and in spaced apart relation about its periphery. It will be appreciated that specific spacing and positioning of such ventilators varies, depending on different factors, such as the type of roofing construction, its location relative to prevailing winds, adjoining or adjacent buildings and the partitioning, if any, of the underlying building interior.

An important characteristic of the disclosed ventilator is that it may be provided to the user in a one-piece unit ready for quick and easy installation on the job without maintenance requirements and with no moving parts. In most cases, after an appropriate opening has been formed in an existing roof or new roof installation, a ventilator of this invention is simply installed and sealed off with flashing without further user requirements.

The disclosed ventilator operates to combat fires by feeding oxygen to the fire site and controlling venting at the fire site. Any fire or spread of fire is controlled by allowing combustible matter to burn over a longer period within a cooler atmosphere through the use of such ventilators. Such venting reduces buildup of heat, gases and smoke to thereby reduce the chance of an explosion occurring when oxygen is introduced to an enclosed area during fire fighting. Moreover, such venting reduces the buildup of heat within the building compartments defined by ceilings, walls, doors, etc. adjacent the fire site.

As will be apparent to persons skilled in the art, various modifications, adaptations and variations of the foregoing specific disclosure can be made without departing from the teachings of this invention.

I claim:

1. A building construction comprising a building structure and a ventilator, the ventilator including a stack defining a passage having an inlet and an outlet communicating with one another, a closure operative to normally seal the passage, insulating material supported by the closure and providing an air seal within the passage under normal conditions, and normally inoperative vent actuating means associated with the closure, the vent actuating means being operative in response to the presence of combustion products for disabling the closure, the closure and the insulating material being automatically released from the passage of the stack upon disablement of the closure whereby the combustion products are exhausted through the passage of the stack to atmosphere.

2. The construction of claim 1 wherein the closure normally seals a base of the stack at the inlet of the stack passage.

3. The construction of claim 1 wherein the building structure includes a roof having an opening therein, and wherein the ventilator is installed within the opening in the roof.

4. The construction of claim 3 wherein the passage inlet and outlet communicate opposite lower and upper surfaces of the roof.

5. The construction of claim 1 wherein the closure has a peripheral rim located radially outwardly of the stack at its inlet, and wherein the vent actuating means includes a retainer for securing the closure to the building structure, the retainer having at least a portion thereof formed of fusible material which automatically releases the closure to drop under the force of gravity when subjected to heat of a fire.

6. The construction of claim 1 wherein the building structure includes a roof, wherein the ventilator stack is supported in fixed relation to the roof, wherein the vent actuating means includes a retainer supporting the closure in fixed underlying relation to the ventilator stack, the retainer being formed at least in part of fusible material for releasing the closure in response to the presence of heat, thereby venting the underside of the roof to atmosphere.

7. The construction of claim 1 wherein the vent actuating means includes fusible material incorporated within the closure, such that when subjected to heat the fusible material liquifies and the closure is rendered ineffective, thereby opening the passage of the stack.

8. The construction of claim 1 wherein the closure includes meltable material incorporated therein and comprising said vent actuating means, the meltable material being of a type which loses its rigidity upon being subjected to heat such that the closure is rendered ineffective, thereby opening the passage of the stack.

9. The construction of claim 1 further including a sensor and a control element, the sensor being electrically connected to provide a signal to the control element, the control element being operatively connected to the vent actuating means for energizing the same responsive to a signal received from the sensor for indicating the presence of combustion products.

10. The construction of claim 1 wherein the stack extends upwardly from the lower surface of a roof of the building structure and protrudes upwardly from its upper surface, the stack having a cover mounted in spaced overlying relation to its outlet, and the insulating material being supported within the stack by the closure in its normally inoperative condition and filling the stack passage to effect an air seal therein of high integrity.

11. The construction of claim 10 further including flashing in overlying relation to adjacent portions of the stack and a surrounding upper surface of a roof of the building structure for providing a seal of high integrity therebetween.

* * * * *